US009513578B2

(12) United States Patent
Torii et al.

(10) Patent No.: US 9,513,578 B2
(45) Date of Patent: Dec. 6, 2016

(54) DEVELOPING DEVICE, PROCESS CARTRIDGE AND IMAGE FORMING APPARATUS

(71) Applicant: CANON KABUSHIKI KAISHA, Tokyo (JP)

(72) Inventors: Go Torii, Mishima (JP); Kiyoshi Furuta, Suntou-gun (JP); Takuya Kawakami, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/840,121

(22) Filed: Aug. 31, 2015

(65) Prior Publication Data

US 2016/0070209 A1 Mar. 10, 2016

(30) Foreign Application Priority Data

Sep. 4, 2014 (JP) ..... 2014-179995

(51) Int. Cl.
*G03G 15/08* (2006.01)

(52) U.S. Cl.
CPC .. *G03G 15/0891* (2013.01); *G03G 2215/0844* (2013.01)

(58) Field of Classification Search
CPC ..... G03G 21/1647; G03G 21/1676; G03G 21/1821; G03G 15/0898; G03G 15/0865; G03G 21/1842; G03G 15/0891
See application file for complete search history.

(56) References Cited

U.S. PATENT DOCUMENTS 5,966,568 A * 10/1999 Numagami ..... G03G 21/1825 222/DIG. 1
6,033,820 A * 3/2000 Hayashi ..... G03G 9/0825 430/108.22
2013/0142541 A1* 6/2013 Hayashida ..... G03G 15/0898 399/106
2014/0212166 A1* 7/2014 Takeuchi ..... G03G 15/0898 399/106
2014/0348535 A1* 11/2014 Murakami ..... G03G 15/0882 399/106
2015/0003865 A1* 1/2015 Batori ..... G03G 15/0882 399/106

FOREIGN PATENT DOCUMENTS

JP 2005-049760 A 2/2005

* cited by examiner

*Primary Examiner* — Francis Gray
(74) *Attorney, Agent, or Firm* — Fitzpatrick, Cella, Harper & Scinto

(57) ABSTRACT

A developing device includes a developer chamber in which developer is accommodated, a developer supplying chamber in which a developer carrying member for developing a latent image forming on an image bearing member is rotatably provided and which is provided with an opening communicating with the developer chamber, a sealing member for sealing the opening, and a feeding member for feeding the developer from the developer chamber to the developer supplying chamber through the opening. The feeding member is rotatably provided in the developer chamber and has a rotation center below a rotation center of the developer carrying member. A part of the developer supplying chamber defining a periphery of the opening and a part of a lower inner surface of the developer supplying chamber are provided in the same plane, and the same plane is flush with or provided above a lower inner surface of the developer chamber.

15 Claims, 11 Drawing Sheets

DEVELOPING DEVICE, PROCESS CARTRIDGE AND IMAGE FORMING APPARATUS

FIELD OF THE INVENTION AND RELATED ART

The present invention relates to a developing device for use with an image forming apparatus, a process cartridge and the image forming apparatus.

Here, the image forming apparatus is an apparatus for forming an image on a recording material by using an image forming process of known various image forming principles or types, such as an electrophotographic process, an electrostatic recording process and magnetic recording process. Examples of the image forming apparatus may include a copying machine, a printer (LED printer, laser printer or the like), a facsimile apparatus, a word processor, and an image display apparatus (electronic blackboard or electronic white board).

The recording material is a material on which the image is to be formed, and includes, e.g., paper (sheet), an OHT sheet, a secondary transfer member, photosensitive paper, electrostatic recording paper.

A cartridge is prepared by integrally assembling an image bearing member on which an image is to be formed and a part or all of image forming process means actable on the image bearing member, into a unit. Then, the cartridge is detachably mounted into an apparatus main assembly of the image forming apparatus and contributes to the image forming process for forming the image on the recording material. Examples of the cartridge may include a process cartridge, a developing cartridge and a developer cartridge. The apparatus main assembly of the image forming apparatus is an image forming apparatus constituent portion excluding the cartridge in the image forming apparatus of a cartridge type.

Examples of the image bearing member may include an electrophotographic photosensitive member in the electrophotographic process, an electrostatic recording dielectric member in the electrostatic recording process, a magnetic recording (magnetic) material in the magnetic recording process, and members capable of forming images through formation of a latent image by other various image forming principles or types. The image forming process means is an image forming process means or device for forming the image by acting on the image bearing member.

Developer (toner) is magnetic or non-magnetic visualizing fine powder for developing the latent image by being deposited on the latent image formed on the image bearing member. The color of the developer is not only a chromatic color but also white or transparent.

In the following, for convenience, description will be made by taking the electrophotographic image forming apparatus of a process cartridge type as an example. In the electrophotographic image forming apparatus, an electrophotographic photosensitive member generally of a drum type as an image bearing member, i.e., a photosensitive drum, is electrically charged uniformly. Then, the charged photosensitive drum is subjected to selective exposure to light, whereby an electrostatic latent image (electrostatic image) is formed.

Then, a toner as developer filled in a toner chamber (developer chamber) in a developing unit (developing device) is fed by a feeding member to a developer carrying member, and then the electrostatic latent image formed on the photosensitive drum is developed into a toner image.

Thereafter, the toner image is transferred from the photosensitive drum onto a recording material (recording medium) such as a recording sheet or a plastic sheet, and then heat and pressure are applied to the toner image transferred on the recording material, so that the toner image is fixed on the recording material and thus image recording is effected.

Such an image forming apparatus requires toner supply and maintenance of various process means in general. In order to facilitate the toner supply and the maintenance, a process cartridge type in which the photosensitive drum, a charging means, a developing means, a cleaning means and the like are integrally assembled into a cartridge (unit) in a frame and the cartridge is used as a process cartridge detachably mountable to the image forming apparatus main assembly has been put into practical use.

According to this process cartridge type, the maintenance of the image forming apparatus can be made by a user himself (herself), and therefore operativity can be remarkably improved, so that it is possible to provide an image forming apparatus excellent in usability. For that reason, the process cartridge type has been widely used in the image forming apparatus.

In such a process cartridge, in order to reduce a cost, a casing of the developing unit is formed by upper and lower (two) frames consisting of a first frame as a developing container and a second frame as a bottom member covering a lower portion of the first frame.

In the first frame side, an opening is formed, so that the developing unit is divided into a toner chamber in which the toner is charged and a toner supplying chamber (developer supplying chamber) in which the toner is supplied to the developer carrying member. Inside the toner chamber, the feeding member is provided, and as described above, the toner is fed by the feeding member to a developing roller as the developer carrying member. In a conventional constitution, a constitution in which a rotation center of the feeding member is positioned below a rotation center of the developing roller and the toner is scooped up into the developer carrying member was employed.

At a periphery of the opening of the first frame, a flange on which a toner sealing member is melted is formed. This is because the sealing member for preventing toner leakage from the toner chamber during transportation is provided to seal the opening. In the conventional constitution, the sealing member was provided from the toner supplying chamber side, and therefore the flange was extended in between the toner chamber and the toner supplying chamber (Japanese Laid-Open Patent Application 2005-49760).

However, in the constitution in which the flange is extended in between the toner chamber and the toner supplying chamber, the toner is stagnated at a lower portion of the toner supplying chamber, so that there was a possibility that the stagnated toner was not able to be used up.

SUMMARY OF THE INVENTION

The present invention is a further development of the above-described conventional constitution.

A principal object of the present invention is to provide a developing device improved in circulation of developer in a developer supplying chamber by reducing a degree of stagnation of the developer at a lower portion of the developer supplying chamber.

Another object of the present invention is to provide a process cartridge including the developing device.

A further object of the present invention is to provide an image forming apparatus using the developing device and the process cartridge.

According to an aspect of the present invention, there is provided a developing device comprising: a developer chamber in which developer is accommodated; a developer supplying chamber in which a developer carrying member for developing a latent image forming on an image bearing member is rotatably provided and which is provided with an opening communicating with the developer chamber; a sealing member for sealing the opening; and a feeding member for feeding the developer from the developer chamber to the developer supplying chamber through the opening, wherein the feeding member is rotatably provided in the developer chamber and has a rotation center below a rotation center of the developer carrying member, wherein a part of the developer supplying chamber defining the opening and a part of a lower inner surface of the developer supplying chamber are provided in the same plane, and the same plane is flush with or provided above a lower inner surface of the developer chamber.

According to another aspect of the present invention, there is provided a developing device comprising: a first frame, provided with an opening, constituting an upper portion of the developing device; a second frame constituting a bottom of the casing; a developer chamber and a developer supplying chamber formed by connection between the first frame and a second frame to communicate with each other through the opening; a sealing member for sealing the opening; a developer carrying member, rotatably provided in the developer supplying chamber, for carrying developer; and a feeding member for feeding the developer from the developer chamber to the developer supplying chamber through the opening, wherein the feeding member is rotatably provided in the developer chamber and has a rotation center below a rotation center of the developer carrying member, wherein a part of the first frame defining the opening and a part of the first frame forming a lower inner surface of the developer supplying chamber are provided in the same plane, and the same plane is flush with or provided above a lower inner surface of the developer chamber.

According to another aspect of the present invention, there is provided a process cartridge detachably mountable to a main assembly of an image forming apparatus for forming an image on a recording material, the process cartridge comprising at least: a rotatable image bearing member on which a latent image is to be formed; and the above-described developing device.

According to a further aspect of the present invention, there is provided an image forming apparatus for forming the image on the recording material, comprising: the rotatable image bearing member on which the latent image is to be formed; and the above-described developing device.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described in detail with reference to the drawings. Here, in the following description, a rotational axis direction of an electrophotographic photosensitive drum 62 as an image bearing member is a longitudinal direction. Further, with respect to the longitudinal direction, a side in which the electrophotographic photosensitive drum 62 receives a driving force from an apparatus main assembly A of an image forming apparatus 100 is a driving side, and an opposite side thereof is a non-driving side. Upper (above) and lower (below) are those with respect to a gravitational direction.

The scope of the present invention is not intended to be limited to functions, materials, shapes, relative arrangement and the like of constituent elements described in the following embodiments unless otherwise specified.

[Embodiment 1]

(General Structure of Electrophotographic Image Forming Apparatus)

Figure 2:
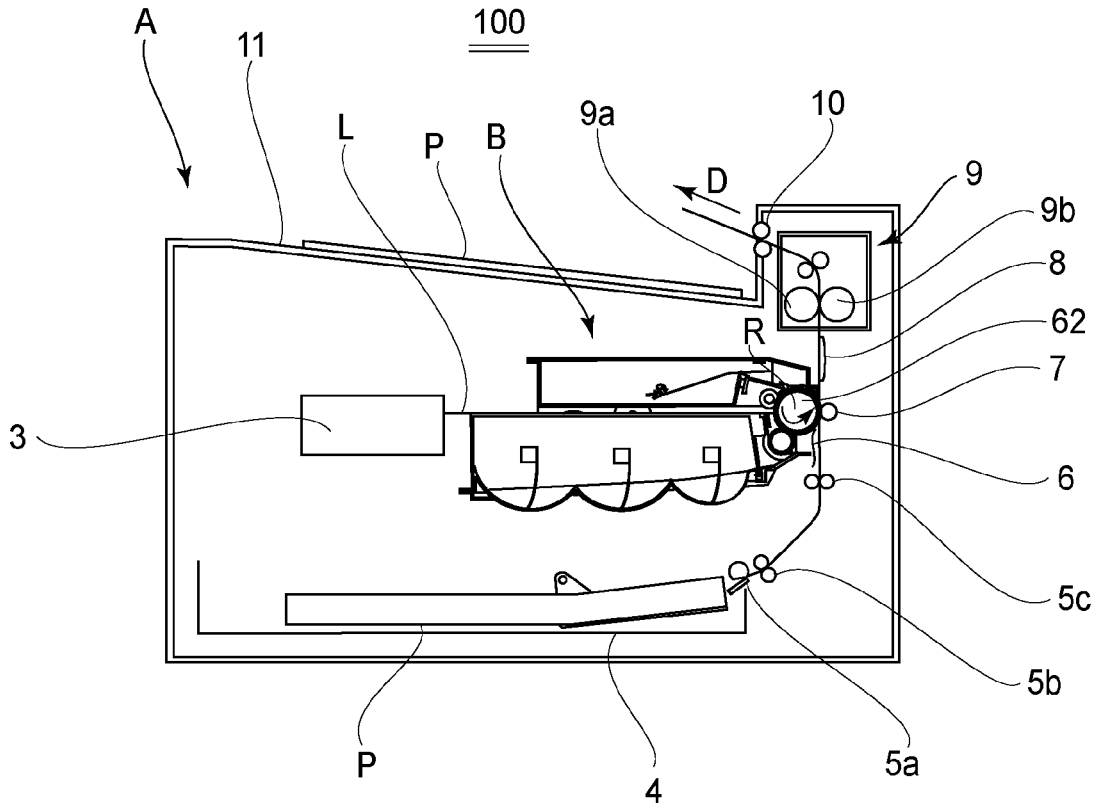
FIG. 2 is a longitudinal sectional view of an image forming apparatus according to Embodiment 1.

FIG. 2 is a longitudinal schematic view of the image forming apparatus 100 in Embodiment 1. This image forming apparatus 100 is a laser beam printer in which a process cartridge B is detachably mountable to the apparatus main assembly A and which uses electrophotographic technology.

When the cartridge B is mounted in the apparatus main assembly A, at a position opposing the electrophotographic photosensitive drum (electrophotographic photosensitive member of a drum type) 62, an exposure device (laser scanner unit) 3 is provided. Further, below the cartridge B, a sheet (feeding) tray 4 in which a recording material (sheet material) P to be subjected to image formation is accommodated is provided.

Further, in the apparatus main assembly A, along a feeding direction D of the sheet material P, a pick-up roller 5*a*, a feeding roller pair 5*b*, a conveying roller pair 5*c*, a transfer guide 6, a transfer roller 7, a feeding guide 8, a fixing device 9, a discharging roller pair 10, a discharging tray 11 and the like are successively provided. The fixing device 9 is constituted by a heating roller 9*a* and a pressing roller 9*b*.

<Image Forming Process>

Figure 3:
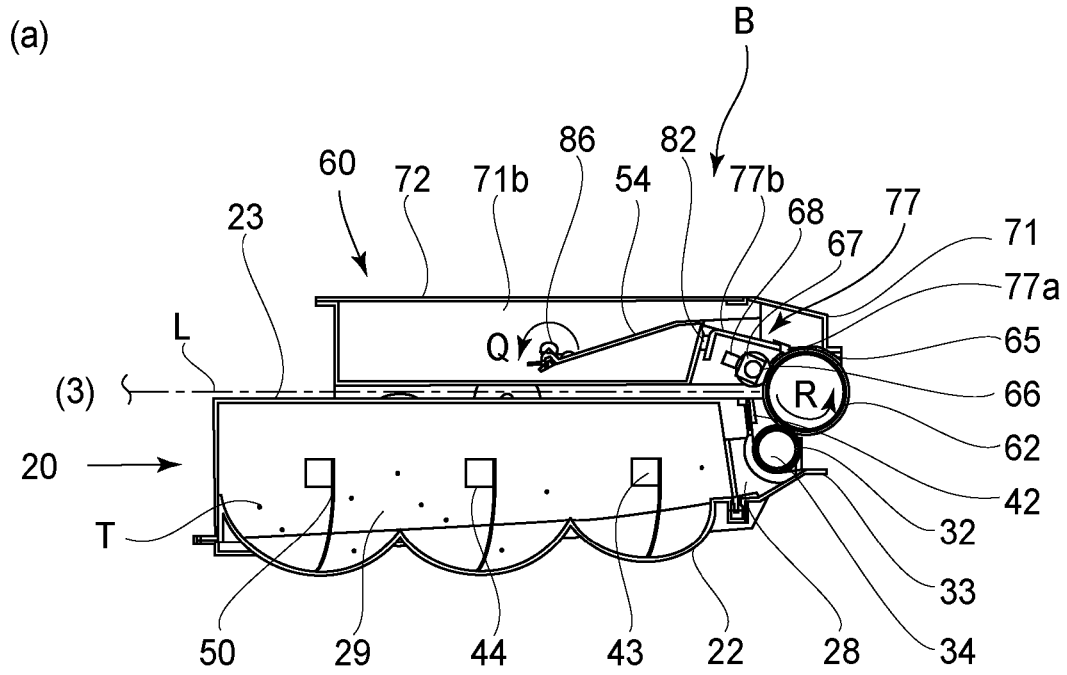
In FIG. 3, (a) is an enlarged schematic view of a process cartridge portion of the image forming apparatus shown in FIG. 2, and (b) is an enlarged schematic view of the developing roller and its peripheral portion shown in (a) of FIG. 3.
Figure 3:
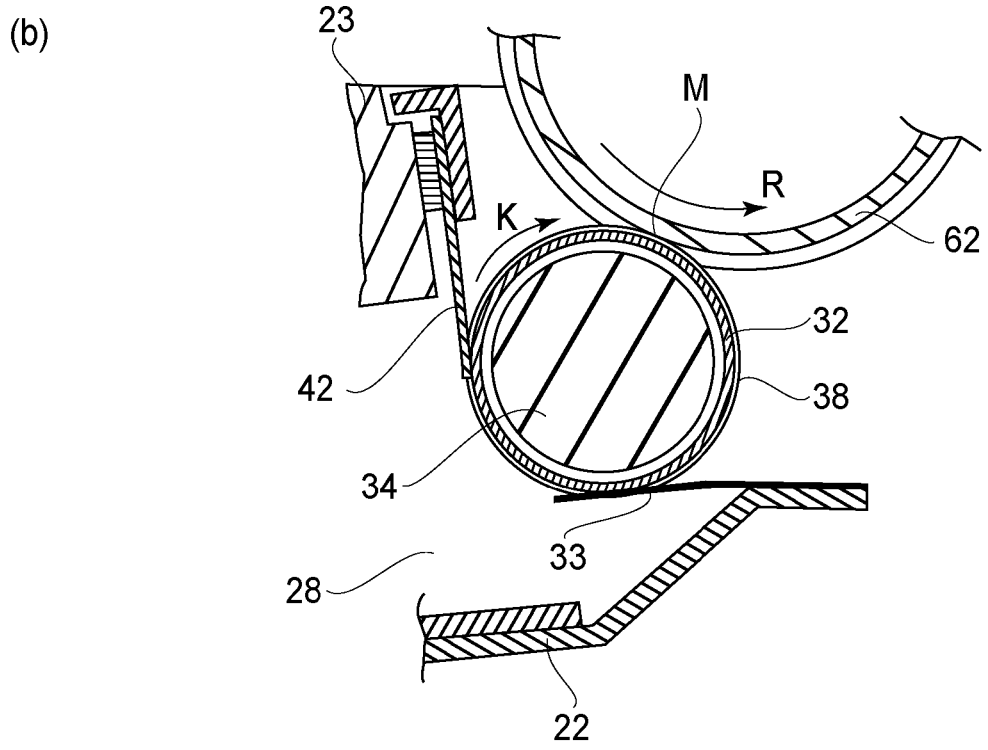

In FIG. 3, (a) is an enlarged schematic view of a portion of the cartridge B shown in FIG. 2, and (b) is an enlarged schematic view of a developing roller 32 and its peripheral member shown in (a) of FIG. 3. Using FIGS. 2 and 3, an outline of an image forming process of the image forming apparatus 100 will be described. In this embodiment, the cartridge B is roughly an assembly of a cleaning unit 60 and a developing unit 20 as a developing device. The cleaning unit 60 includes the drum 62, a charging roller 66, a cleaning blade 77 and the like. The developing unit 20 includes a developing roller 32 as a developer carrying member, and the like. This cartridge B will be specifically described hereinafter.

On the basis of a print start signal, the drum 62 is rotationally driven at a predetermined peripheral speed (process speed) in an arrow R direction. Further, the charging roller 66 to which a bias voltage is applied contacts the outer peripheral surface of the drum 62 and electrically charges the outer peripheral surface of the photosensitive drum 62 uniformly. The exposure device 3 outputs laser light L depending on image information. The laser light L passes through between a developing container 23 as a first frame and a cleaning frame 71, so that an outer peripheral surface of the drum 62 is subjected to scanning exposure. As a result, on the outer peripheral surface of the drum 62, an electrostatic latent image depending on the image information is formed.

On the other hand, in the developing unit 20 as the developing device, a toner (one-component magnetic developer in this embodiment) T as developer in a toner chamber (developer chamber) 29 is stirred by rotation of a first feeding member 43, a second feeding member 44 and a third feeding member 50. T toner T in the toner chamber 29 is successively fed from a rear side, remote from a toner supplying chamber (developer supplying chamber) 28, toward the toner supplying chamber 28, thus being sent to the toner supplying chamber 28.

In the toner supplying chamber 28, a developing roller 32 as a developer carrying member to be rotationally driven at a predetermined peripheral speed in an arrow K direction is provided. The toner T in the toner supplying chamber 28 is carried by a magnetic force of a magnet roller 34 (magnet), non-rotatably fixed inside the developing roller 32, on a surface of the developing roller 32.

The toner T carried on the surface of the developing roller 32 is regulated in layer thickness by a developing blade 42 while being triboelectrically charged. The toner T is transferred onto the drum 62 depending on the electrostatic latent image at a developing portion M which is an opposing gap portion between the developing roller 32 and the drum 62, so that the electrostatic latent image is visualized (developed) as a toner image. The toner on the developing roller, which is not subjected to development of the latent image is returned and fed into the toner supplying chamber 28 by further rotation of the developing roller 32.

On the other hand, in synchronism with output timing of the laser light L from the exposure device 9, by the pick-up roller 5*a*, the feeding roller pair 5*b* and the conveying roller pair 5*c*, one sheet material P stacked and accommodated in the sheet tray 4 provided at a lower portion of the apparatus main assembly A is fed. Then, the sheet material P is fed to a transfer position which is a contact nip between the drum 62 and the transfer roller 7 via the transfer guide 6, and then is nipped and conveyed. In this transfer position, the toner image is successively transferred from the drum 62 onto the sheet material P.

The sheet material P on which the toner image is transferred is separated from the drum 62 and then is fed to the fixing device 9 along the conveying guide 8. Then, the sheet material P passes through a fixing nip between the heating roller 9*a* and the pressing roller 9*b* which constitute the fixing device 9. At this fixing nip, a pressure and heat-fixing process is effected, so that the toner image is fixed on the sheet material P. The sheet material P on which the toner image is fixed is fed to the discharging roller pair 10 and then is discharged onto the discharge tray 11.

Further, the drum 62 after the toner image transfer is, after a residual toner on the outer peripheral surface of the drum 62 is removed by a cleaning blade 77, used again in the image forming process. The residual toner removed from the drum 62 is stored in a residual toner chamber 71*b* of the cleaning unit 60. In the above, the charging roller 66, the developing roller 32 and the cleaning blade 77 are process means actable on the drum 62.

<Mounting and Demounting of Cartridge>

Figure 4:
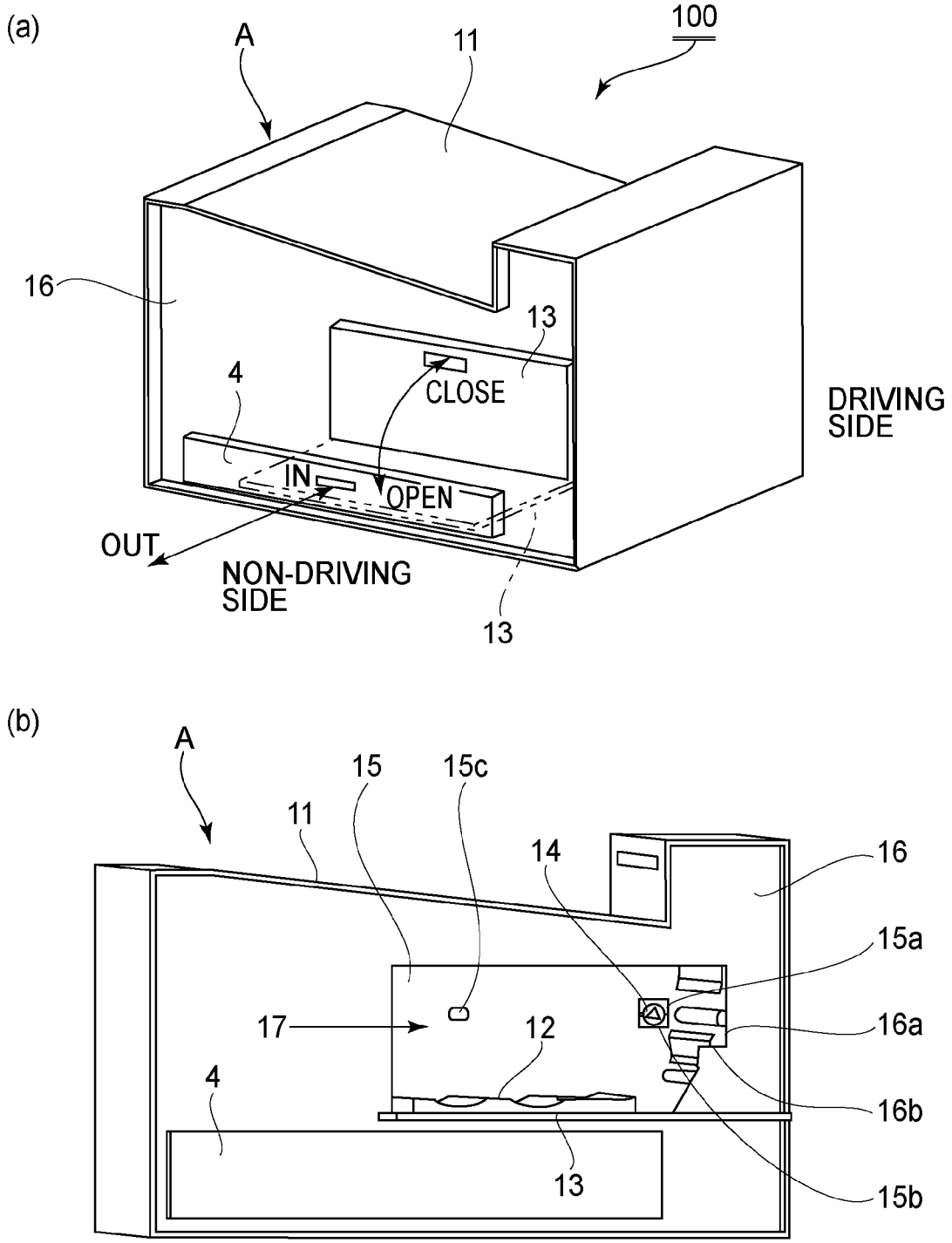
In FIG. 4, (a) is a perspective view of the image forming apparatus in a state in which an openable door (open/close door) is closed, and (b) is a perspective view of the image forming apparatus in a state in which the openable door is opened and a process cartridge is not mounted.

Next, mounting and demounting of the cartridge B will be described. In FIG. 4, (a) is a schematic perspective view of an outer appearance of the image forming apparatus 100 as seen from a non-driving side. In this embodiment, with respect to the image forming apparatus 100, the non-driving side is a front surface side (front side), and a driving side which is an opposite side from the non-driving side is a rear surface side (rear side). In the front side of the apparatus main assembly A, a non-driving side-side plate 16 is provided with a cartridge inserting opening 17 as shown in (b) of FIG. 4. In an outer surface side of the non- driving side-side plate 16, an openable door 13 for opening and closing the cartridge inserting opening 17 is provided.

The openable door 13 is raised and rotated toward the non-driving side-side plate 16 about a hinge portion (not shown) provided in a lower edge side, so that the openable door 13 can be operated to be moved to a closed position where the cartridge inserting opening 17 is closed. Further, the openable door 13 is tilted and rotated from the closed position toward the front side substantially horizontally, so that the openable door 13 can be operated to be moved to an open position where the cartridge inserting opening 17 is open. In a state in which the openable door 13 is moved to the open position and thus the cartridge inserting opening 17 is open, the cartridge B can be mounted and demounted from a cartridge mounting portion in the apparatus main assembly A through the cartridge inserting opening 17.

The sheet tray 4 can be subjected to a replenishing operation of the sheet material P by being pulled out from inside the apparatus main assembly A to the front side. Then, the sheet tray 4 can be returned to a predetermined position in the apparatus main assembly A by being pushed in and moved to the predetermined position (front loading type).

At the cartridge mount portion in the apparatus main assembly A, a guide rail 12 for guiding the cartridge B in a mounting direction from the front side toward the rear side in the apparatus main assembly A and in a demounting direction opposite to the mounting direction is provided.

Figure 5:
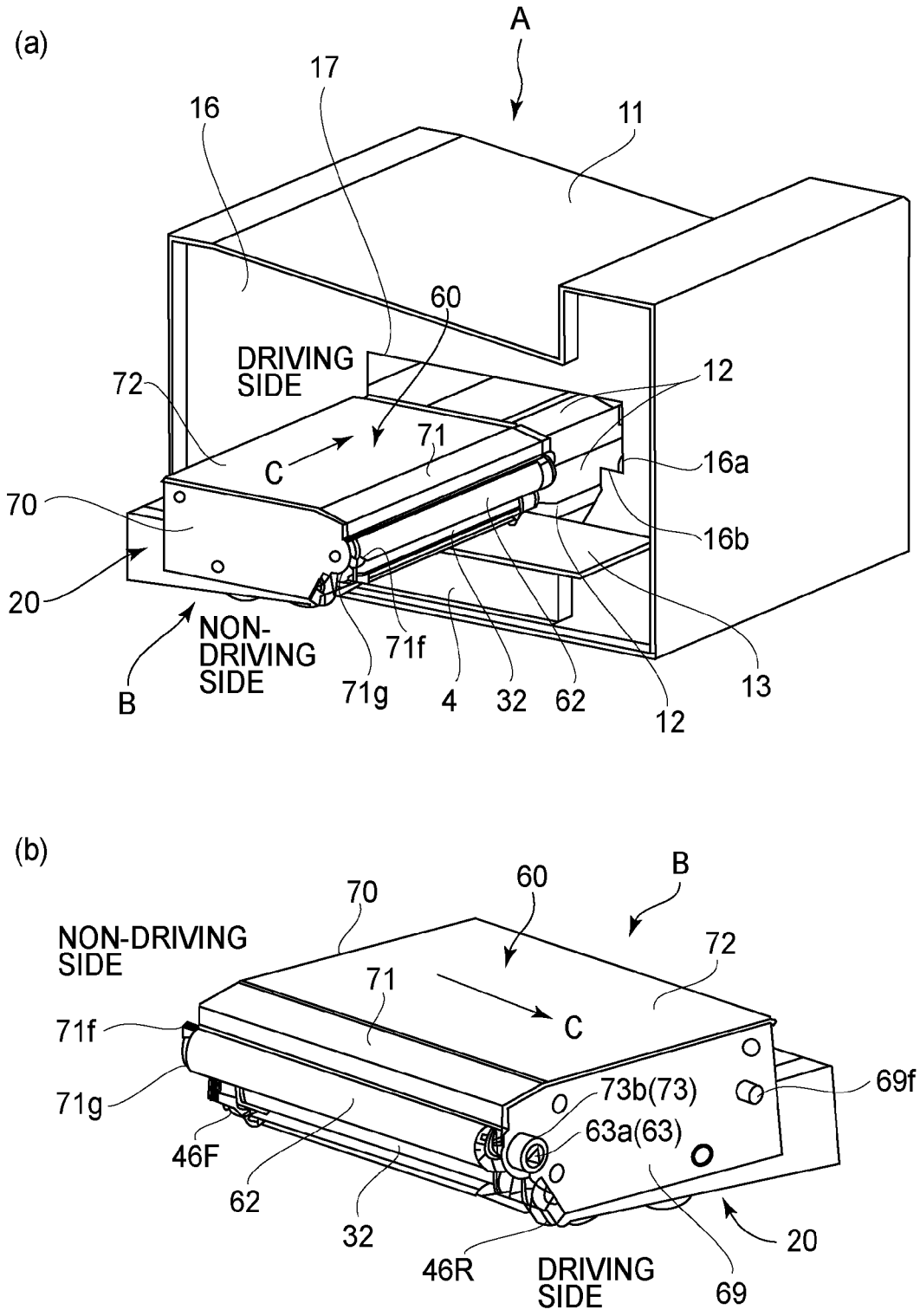
In FIG. 5, (a) is an illustration of a manner of mounting the process cartridge into an apparatus main assembly, and (b) is a perspective view of the contact as seen from a driving side.

For the mounting of the cartridge B into the apparatus main assembly A, as shown in (a) of FIG. 5, the openable door 13 is opened, so that the cartridge inserting opening 17 is opened. Through the cartridge inserting opening 17, the driving side of the cartridge B is inserted first into the apparatus main assembly A, and a bottom (surface) of the cartridge B in the driving side is placed on and received by the guide rail 12. Then, the cartridge B is pushed in and inserted in an arrow C direction in (a) of FIG. 5 from the front side to the rear side in the apparatus main assembly A while being slid on the guide rail 12.

When the cartridge B is sufficiently pushed in and inserted, the driving side of the cartridge B is received by a driving side-receiving portion (not shown) of the apparatus main assembly A, so that further pushing-in movement of the cartridge B is prevented. Then, the openable door 13 is closed, so that the cartridge inserting opening 17 is closed (covered). As a result, the mounting of the cartridge B into the apparatus main assembly A is completed. In this state, the image forming apparatus 100 is in a state in which an image forming operation is capable of being performed.

In the case where the cartridge B to be mounted is an unused new cartridge, when the cartridge B is mounted, a removing operation of a sealing member 45 sealing an opening 1 provided in a flange 25 (FIG. 1) provided between the toner chamber 29 and the toner supplying chamber 28 of the developing unit 20 is performed. The sealing member 45 is removed and the opening 1 is opened, so that the toner chamber 29 and the toner supplying chamber 28 communicate with each other through the opening 1 and thus the toner accommodated in the toner chamber 29 side can be fed and supplied to the toner supplying chamber 28. A removing manner of the sealing member 45 will be described later.

In a state in which the cartridge B is mounted at the cartridge mounting portion in the apparatus main assembly A in a predetermined manner, a driving force-receiving portion 63*a* ((b) of FIG. 5) in the driving side of the cartridge B corresponds to a driving shaft 14 ((b) of FIG. 14) in the driving side of the apparatus main assembly A. The driving shaft 14 is driven by a motor (not shown) in the apparatus main assembly A side, so that a driving force of the driving shaft 14 is transmitted to the driving force-receiving portion 63*a*. As a result, the drum 62 connected with the driving force-receiving portion 63*a* receives the driving force from the apparatus main assembly A, so that the drum 62 is rotationally driven.

Then, a rotational driving force of the drum 62 is transmitted to driven members such as the developing roller 32, the first to third feeding members 43, 44 and 50, a residual toner feeding member 54 and the like of the developing unit 20 via a power transmitting mechanism portion (not shown). Further, to the charging roller 66 and the developing roller 32, electric power supply (predetermined bias (voltage) application) is made by an electric power supplying portion (not shown) of the apparatus main assembly A.

The demounting of the cartridge B mounted in the apparatus main assembly A is made in a reverse procedure to that in the case of the mounting described above. That is, the cartridge inserting opening 17 is opened by opening the openable door 13, and then the cartridge B mounted in the apparatus main assembly A is pulled toward the front side through the cartridge inserting opening 17 and is pulled out to an outside of the apparatus main assembly A through the cartridge inserting opening 17 while being slid on the guide rail 12.

<Support of Cartridge B>

A supporting constitution of the cartridge B mounted in the apparatus main assembly A will be principally described with reference to (b) of FIG. 4 and (b) of FIG. 5. The apparatus main assembly A is provided with a driving side-side plate 15 and the non-driving side-side plate 16 for supporting the cartridge B. The driving side-side plate 15 is provided with a driving side-first supporting portion 15*a*, a driving side-second supporting portion 15*b* and an elongated hole 15*c* as a rotation supporting portion of the cartridge B. The non-driving side-side plate 16 is provided with a non-driving side-first supporting portion 16*a* and a non-driving side-second supporting portion 16*b*.

Specifically, a supporting portion 73*b* provided on a drum bearing 73 in the driving side of the cartridge B is supported by the driving side-first supporting portion 15*a* and 15*b*. A boss 69*f* provided on a driving side-drum side member 69 of the cartridge B is supported by the elongated hole 15*c*. A non-driving side-first projection 71*f* and a non-driving side-second projection 71*g* provided on the cleaning frame 71 in the non-driving side of the cartridge B are supported by the non-driving side-first supporting portion 16*a* and the non-driving side-second supporting portion 16*b*, respectively.

By the supporting constitution in the driving side and the non-driving side, the cartridge B is supported by the cartridge mounting portion in the apparatus main assembly A.

<General Structure of Cartridge B>

Figure 6:
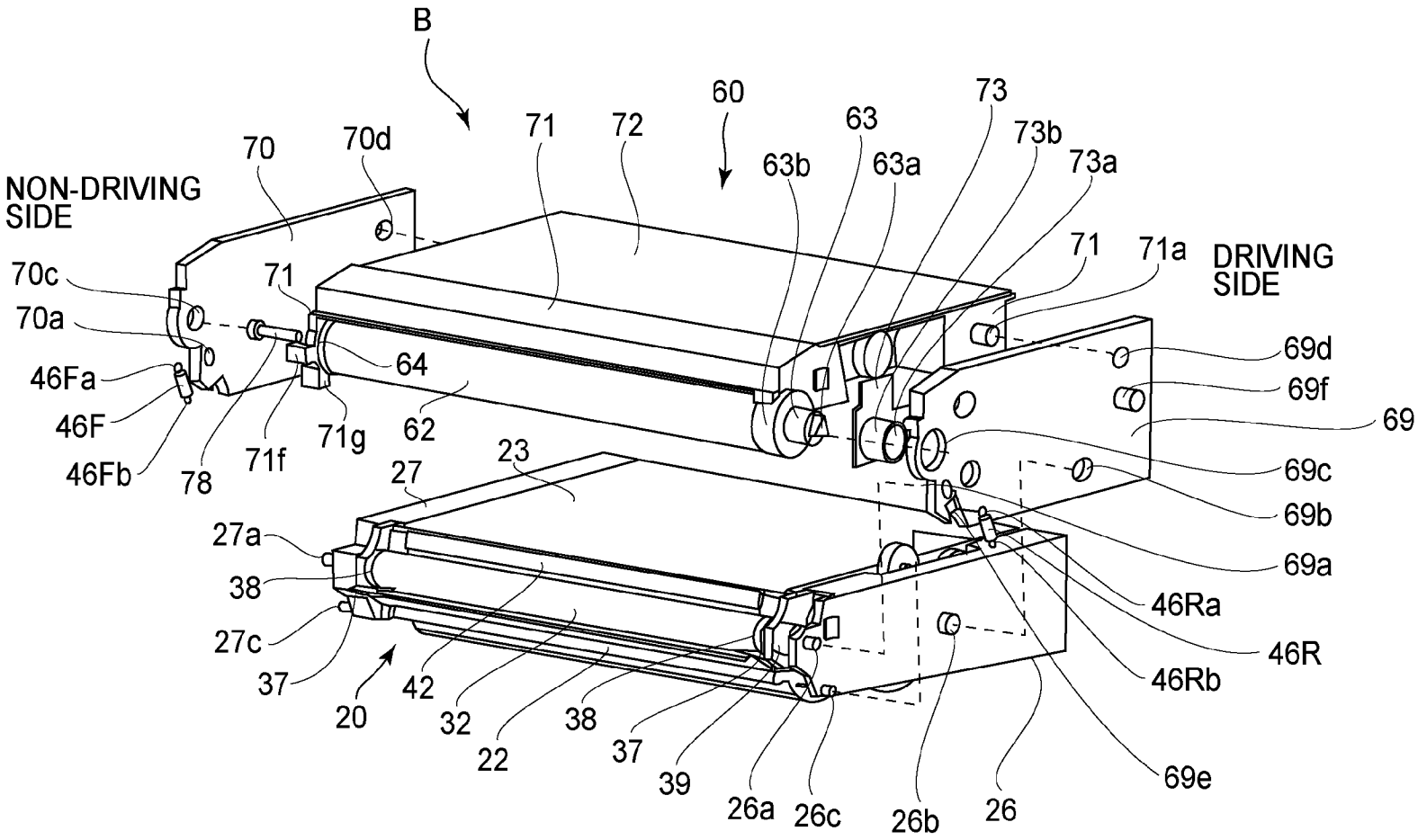
FIG. 6 is an exploded perspective view of the process cartridge as seen from the driving side.
Figure 7:
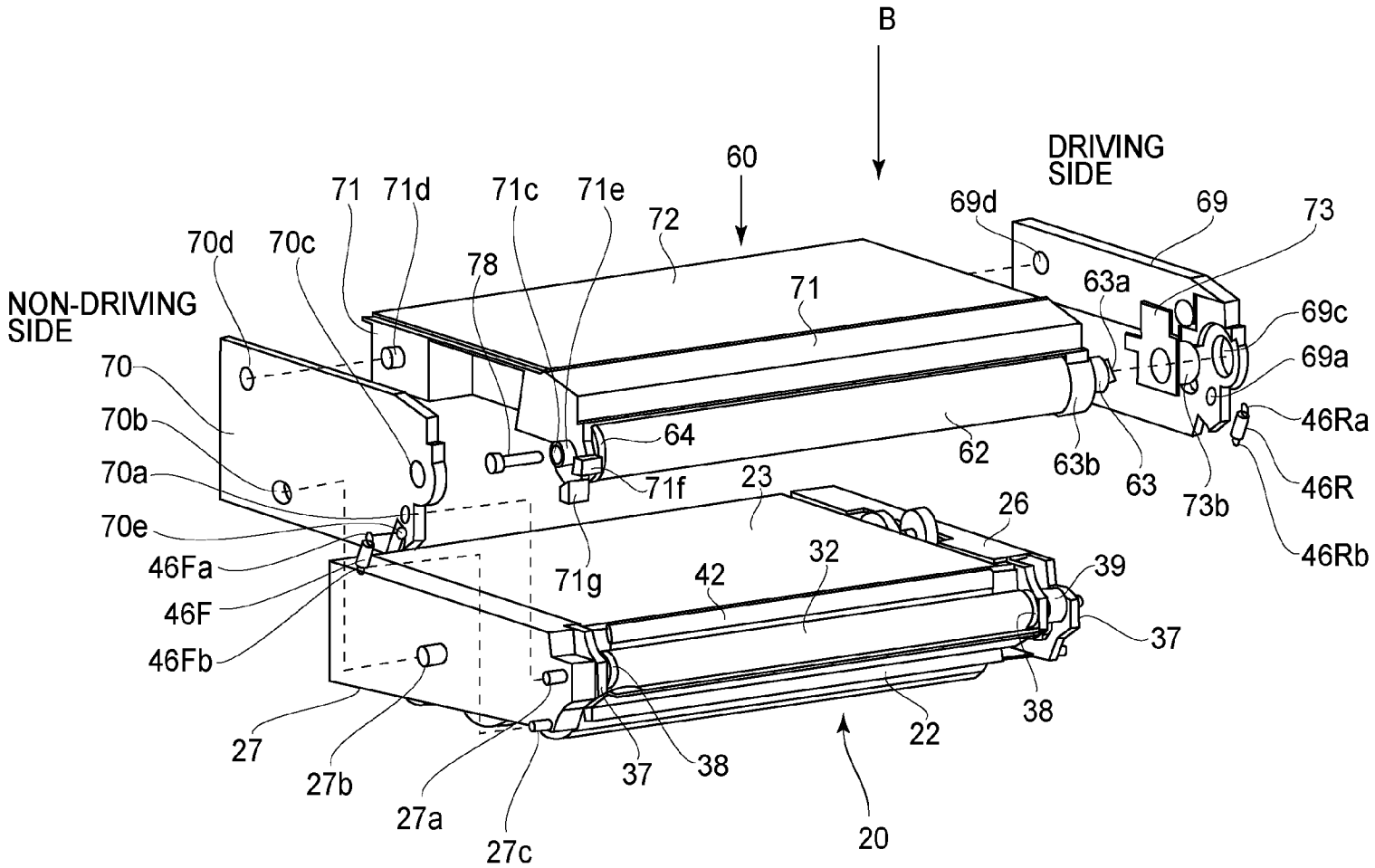
FIG. 7 is an exploded perspective view of the process cartridge as seen from a non-driving side.

A general structure of the cartridge B will be described using FIGS. 3 and 5 to 7. FIG. 6 is an exploded perspective view of the cartridge B as seen from the driving side. FIG. 7 is an exploded perspective view as seen from the non-driving side. In these figures, description will be made by omitting screws during connection of respective components.

The cartridge B in this embodiment is roughly an assembly (so-called integral-type process cartridge) of the cleaning unit 60 and the developing unit 20 as the developing device.

Principally referring to FIG. 3, the cleaning unit 60 includes the drum 62, the charging roller 66, the cleaning member 77, the cleaning frame 71 supporting these members, and a cap member 72 fixed to the cleaning frame 71 by welding on the like. In the cleaning unit 60, the charging roller 66 and the cleaning member 77 are disposed in contact with the outer peripheral surface of the drum 62.

The cleaning member 77 includes a rubber blade 77*a* which is a blade-shaped elastic member formed of a rubber as an elastic material, and a supporting member 77*b* for supporting the rubber blade 77*a*. The cleaning member 77 is provided by mounting the supporting member 77*b* on the cleaning frame 71 via a sealing member 82. The rubber blade 77*a* is contacted to the drum 62 counterdirectionally to a rotational direction of the drum 62. That is, the rubber blade 77*a* is contacted to the drum 62 so that a free end portion thereof is directed upward with respect to the rotational direction of the drum 62.

The residual toner removed from the surface of the drum 62 by the cleaning member 77 is fed by a residual toner feeding member 54 into a residual toner chamber 71*b* formed by the cleaning member 77 and the cap member 72. The residual toner feeding member 54 engages with a crank member 86, and the driving force is transmitted from the crank member 86, so that the residual toner feeding member 54 is rotated in an arrow Q direction in FIG. 3 and feeds the residual toner.

A receptor sheet 65 for preventing leakage of the residual toner stored in the residual toner chamber 71*b* is provided at an edge portion 71 opposing the drum 62 in contact with the drum 62.

The drum 62 is rotationally driven in the arrow R direction depending on the image forming operation by transmitting the driving force, to the cleaning unit 60, of a main assembly driving motor (not shown) which is a driving source. The charging roller 66 is rotatably mounted in the cleaning unit 60 via a charging roller bearing 67 in each of end portion sides with respect to a longitudinal direction (substantially parallel to a rotational axis direction of the drum 62) of the cleaning frame 71. The charging roller 66 is press-contacted to the drum 62 by pressing the charging roller bearing 67 toward the drum 62 by an urging member 68. The charging roller 66 is rotated by the rotation of the drum 62.

The developing unit 20 includes the developing roller 32, a first frame 23 for supporting the developing roller 32, a developing blade 42, and the like. Inside the developing roller 32, a magnet roller (magnet) 34 is fixed and provided non-rotatably. In the developing unit 20, the developing blade 42 for regulating a toner layer on the developing roller 32 is disposed. A gap holding member (spacer roller) 38 is mounted to each of end portions of the developing roller 32, and by contact of the gap holding member 38 with the drum 62, the developing roller 32 is held with a predetermined minute gap with the drum 62 at a developing portion M while opposing the drum 62.

Further, a leakage preventing sheet 33 for preventing leakage of the toner from the developing unit 20 is provided in contact with the developing roller 32 at an edge portion of the second frame 22 as a bottom member opposing the developing roller 32. Further, in the toner chamber 29 formed by the first frame 23 and the second frame 22, the first to third feeding members 43, 44 and 50 are provided. The first to third feeding members 43, 44 and 50 not only stir the toner T accommodated in the toner chamber 29 but also feed the toner T to the toner supplying chamber 28.

That is, the toner T in the toner chamber 29 is stirred by the feeding members 43, 44 and 50 and is fed in the toner chamber 29 from a side remote from the toner supplying chamber 28 toward the toner supplying chamber 28, so that the toner T is sent to the toner supplying chamber 28 and then is supplied to the developing roller 32.

The cartridge B is constituted by combining the cleaning unit 60 and the developing unit 20 which are described above. Principally referring to FIGS. 6 and 7, the cleaning unit 70 includes a cleaning frame 71, a cap member 72, the drum 62, and the driving side drum bearing 73 and the non-driving side-drum shaft 78 which are used for rotatably supporting the drum 62.

The drum 62 rotatably supports a drum flange 63 provided in the driving side by inserting the drum flange 63 into a hole 73*a* of the drum bearing 73. In the non-driving side, the drum shaft 78 is press-fitted in a hole 71*c* provided in the cleaning frame 71 and rotatably supports a hole (not shown) of a non-driving side-drum flange 64.

At a free end portion of the driving side-drum flange 63, the driving force-receiving portion 63*a* corresponding to the driving shaft 14 ((b) of FIG. 4) provided in the driving side of the apparatus main assembly A. The driving side-drum flange 63 is further provided with a flange gear portion 63*b* for transmitting the driving force to a developing roller gear 39 provided in the driving side of the developing roller 32. Further, the driving side-drum side member 69 and a non-driving side-drum side member 70 are provided in end sides of the cleaning frame 71.

A boss 71*a* provided in the driving side of the cleaning frame 71 and the supporting portion 73*b* of the drum bearing 73 mounted on the cleaning frame 71 are inserted into an elongated hole 69*d* and a positioning hole 69*a* of the driving side-drum side member 69. As a result, the driving side-drum side member 69 is positioned and fixed in the driving side of the cleaning frame 71.

Further, a boss 71*d* provided in the non-driving side of the cleaning frame 71 and an outer diameter portion of a cylindrical boss 71*e* into which the drum shaft 78 is to be inserted are inserted into an elongated hole 70*d* and a positioning hole 70*c* of the non-driving side-drum side member 70. As a result, the non-driving side-drum side member 70 is positioned and fixed in the non-driving side of the cleaning frame 71.

On the other hand, the developing unit 20 includes the first frame 23, the second frame 22, a driving side-developing side member 26, a non-driving side-developing side member 27, the developing blade 42, the developing roller 32 and the like. The developing roller 32 is rotatably mounted in the first frame 23 by a bearing member 37 provided at each of ends of the first frame 23. Then, the cartridge B is constituted by slidably supporting the developing unit 20 relative to the cleaning unit 60 by the driving side-drum side member 69 and the non-driving side-drum side member 70.

Specifically, a developing-first supporting portion 26*a* and a developing-second supporting portion 26*b* are provided on the driving side-developing side member 26 in one longitudinal end portion of the developing unit 20. A developing-third supporting portion 27*a* and a developing-fourth supporting portion 27*b* are provided on the non-driving side-developing side member 27.

These supporting portions engage with the first elongated hole 69*a* and the second elongated hole 69*b* provided in the driving side-drum side member 69 and the third elongated hole 70*a* and the fourth elongated hole 70*b* provided in the non-driving side-drum side member 70, respectively. Thus, the developing unit 20 is supported by the cleaning unit 60 via the driving side-drum side member 69 and the non-driving side-drum side member 70.

Further, a first hole 46Ra of a driving side-urging member 46R is hooked on a boss 69*e* of the driving side-drum side member 69, and a second hole 46Rb of the driving side-urging member 46R is hooked on a boss 26*c* of the driving side-developing side member 26. Further, a first hole 46Fa of a non-driving side-urging member 46F is hooked on a boss 70*e* of the non-driving side-drum side member 70, and a second hole 46Fb of the non-driving side-urging member 46F is hooked on a boss 27*c* of the non-driving side-developing side member 27.

In this embodiment, each of the driving side-urging member 46R and the non-driving side-urging member 46F is formed with a tension spring. The developing unit 20 is urged toward the cleaning unit 60 by an urging force of these springs, so that the developing roller 32 is constituted so as to be pressed toward the drum 62 with reliability. Then, by the gap holding member 38 provided at each of the end portions of the developing roller 32, the developing roller 32 is held with a predetermined minute gap with the drum 62.

<Structure of Peripheral Portion of Developing Roller>

Figure 1:
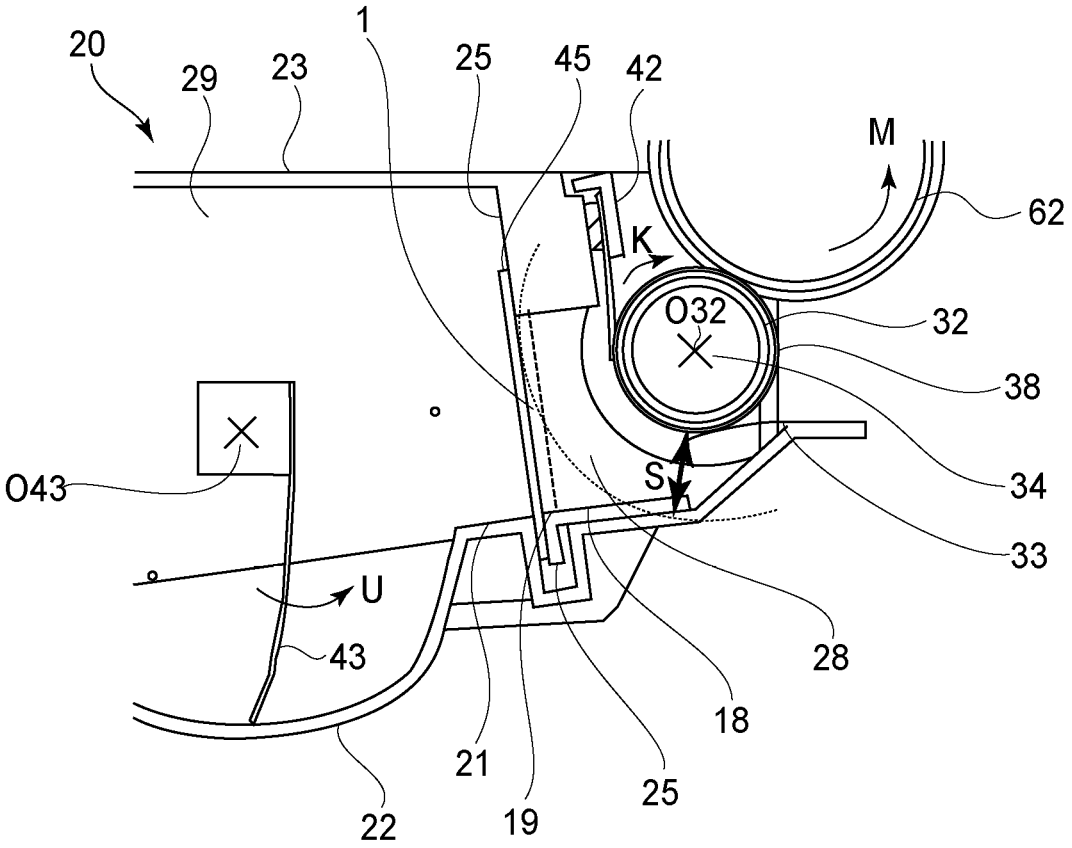
FIG. 1 is a schematic sectional view of a developing roller and its peripheral portion of a process cartridge according to Embodiment 1.
Figure 8:
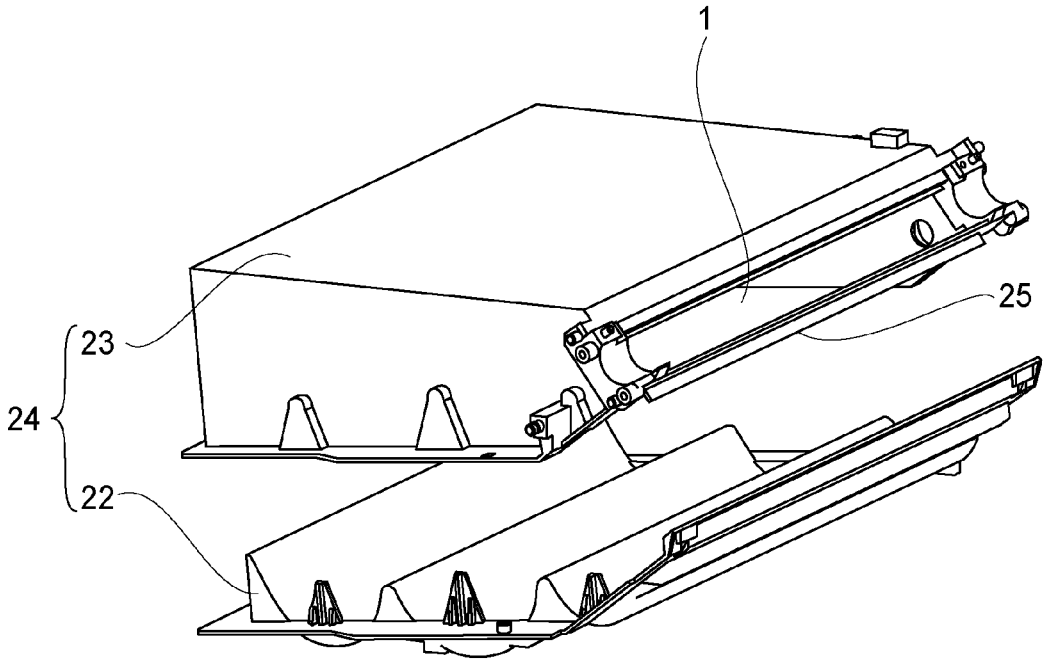
FIG. 8 is an exploded perspective view of a casing constituting a developing unit.

A peripheral portion of the developing roller 32 in the developing unit 20 will be described using FIGS. 1 and 8. FIG. 1 is a sectional view of the developing roller 32 and its peripheral portion in the developing unit 20. FIG. 8 is an exploded perspective view for illustrating a casing 24 of the developing unit 20.

As shown in FIG. 8, the casing 24 of the developing unit 20 is constituted by the first frame 23 and the second frame 22, and the second frame 22 forms a bottom and the first frame 23 is welded with an upper portion of the second frame 22. The first frame 23 is provided with an opening 1, so that the inside of the developing unit 20 is partitioned by the opening 1 as a boundary into two chambers consisting of the toner chamber 29 and the toner supplying chamber 28.

The first frame 23 includes the flange 25 with which the toner sealing member is to be welded. Before the cartridge B in an unused fresh (new) state is inserted into the apparatus main assembly A, as shown in FIG. 1, the toner sealing member 45 is welded with the flange 25 from the toner chamber 29 side.

That is, the flange 25 is disposed between the toner supplying chamber 28 and the toner chamber 29, and the opening 1 for causing the toner supplying chamber 28 and the toner chamber 29 to communicate with each other is formed, and the toner sealing member 45 for sealing (covering) the opening 1 is mounted.

In this way, the opening 1 is sealed with the sealing member 45, so that the toner T filled in the toner chamber 29 is prevented from flowing into the toner supplying chamber 28. The sealing member 45 prevents toner leakage from the cartridge B by maintaining the opening 1 in a sealed state during transportation of the cartridge B in the unused fresh state.

In the case where the cartridge B in the unused fresh state is mounted in the apparatus main assembly A and then is used for image formation, before the cartridge B is mounted in the apparatus main assembly A, there is a need to remove the sealing member 45 from the flange 45 by peeling off the sealing member 45. By removing the sealing member 45, the toner chamber 29 and the toner supplying chamber 28 communicate with each other through the opening 1, so that the toner can flow from the toner chamber 29 side into the toner supplying chamber 28.

As a method of peeling off and removing the sealing member 45 from the flange 25, a method in which an end portion of the sealing member 45 is exposed to an outside of the first frame 23 and then a user pulls and draws off the sealing member 45 is taken, for example. Alternatively, a method in which the sealing member 45 is peeled off by a winding-up mechanism provided inside the cartridge is taken.

The first feeding member 43 is provided in the toner chamber 29. The first feeding member 43 is rotationally driven in an arrow U direction, so that the first feeding member 43 not only stirs the toner accommodated in the toner chamber 29 but also feeds the toner toward the toner supplying chamber 28. The first feeding member 43 has a rotation center 043 disposed below a rotation center 032 of the developing roller 32. For that reason, the first feeding member 43 feeds the toner T toward the developing roller 32 positioned above the first feeding member 43 in a scooping-up manner.

A lower portion of the flange 25 extends downward. For that reason, a part 19, of the first frame 23, defining (forming) a lower inner surface of the opening 1 and a part 18, of the first frame 23, forming a lower inner surface of the toner supplying chamber 28 can be disposed so as to be flush with each other, i.e., in the same plane. In the same plane, also a toner chamber lower inner surface (developer chamber lower inner surface) 21 in the neighborhood of the sealing member 45 is disposed.

The part 19, of the first frame 23, defining the lower inner surface of the opening 1 and the part 18, of the first frame 23, forming the toner supplying chamber lower inner surface exit in the same plane, so that a region where there is a possibility of stagnation of the toner in the toner supplying chamber 28 is eliminated. A constitution in which the toner does not stagnate at the lower portion of the toner supplying chamber 28 since the toner, in the toner chamber 29, fed by rotation of the first feeding member 43 is supplied from the toner supplying chamber 28 to the developing roller 32 after passing through the opening 1 is employed.

As described above, inside the developing roller 32, the magnet roller 34 is provided. The part 18, of the first frame 23, forming the lower inner surface (developer supplying chamber lower inner surface) of the toner supplying chamber 28 is provided within a distance range S in which the toner T which is the one-component developer is held on the developing roller 32 by a magnetic force of the magnet roller 34. It becomes possible to attract the toner to the developing roller 32 at the lower portion of the toner supplying chamber 28, so that the toner is fed with the rotation of the developing roller 32, and thus the toner circulation in the toner supplying chamber 28 is improved.

[Embodiment 2]

Embodiment 2 of the direction will be described based on the drawing. In this embodiment, a portion different from Embodiment 1 described above will be described in detail. Unless otherwise specified again, the materials, the shapes and so on are similar to those in Embodiment 1 described above. Such portions are represented by the same reference numerals or symbols and will be omitted from detailed description.

Figure 9:
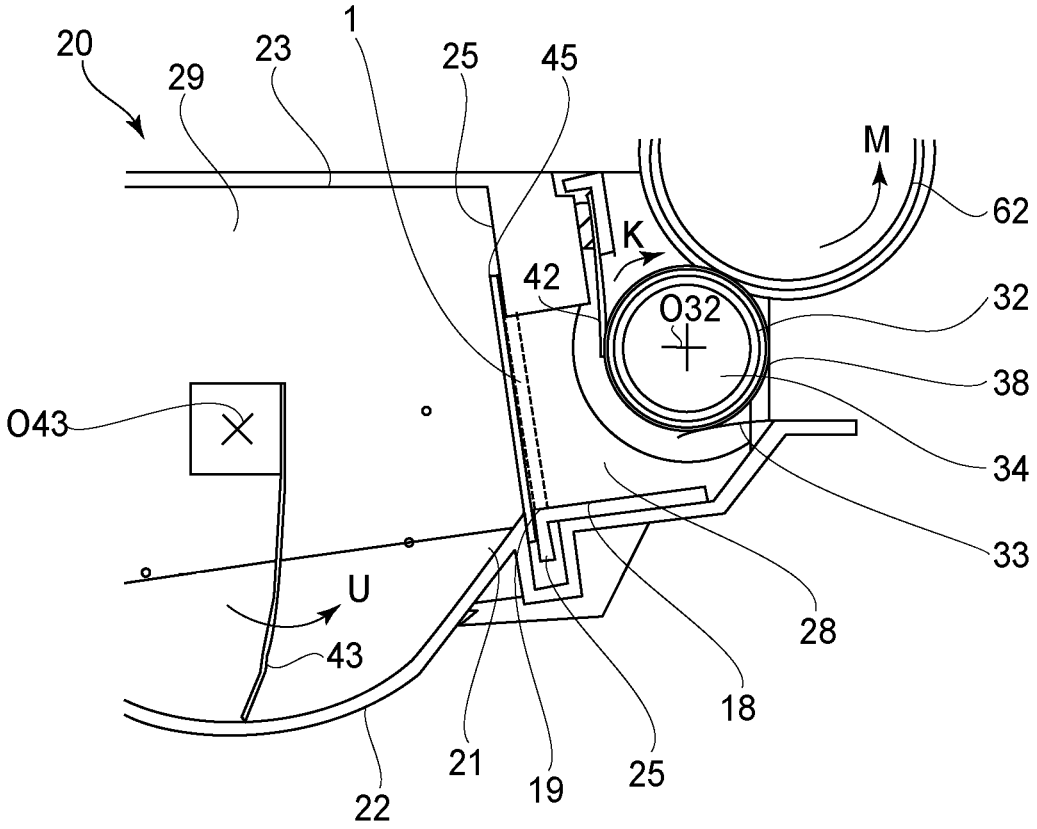
FIG. 9 is a schematic sectional view of a developing roller and its peripheral portion of a process cartridge according to Embodiment 2.

A structure of a peripheral portion of the developing roller 32 in this embodiment will be described using FIG. 9. FIG. 9 is a sectional view of the developing roller 32 and its peripheral portion in the developing unit 20 similarly as FIG. 1.

In Embodiment 2, the part 19, of the first frame 23, defining the opening 1 and the part 18, of the first frame 23, forming the lower inner surface of the toner supplying chamber 28 are disposed in the same plane. In the toner chamber 29 side, in the neighborhood of the toner sealing member 45, a lower inner surface 21 of the toner chamber 29 is formed downward from the opening 1.

The plane in which the part 19, of the first frame 23, defining the opening 1 and the part 18, of the first frame 23, forming the lower inner surface of the toner supplying chamber 28 exist is disposed above the toner chamber lower inner surface 21 in the neighborhood of the sealing member 45. As a result, a region where there is a possibility of stagnation of the toner in the toner supplying chamber 28 is eliminated.

Also in this embodiment, similarly as in Embodiment 1, the toner, in the toner chamber 29, fed by the rotation of the feeding member 43 passes through the opening 1 and is supplied from the toner supplying chamber 28 to the developing roller 32, and therefore the toner does not stagnate at the lower portion of the toner supplying chamber 28.

[Embodiment 3]

Embodiment 3 of the direction will be described based on the drawing. In this embodiment, a portion different from Embodiments 1 and 2 described above will be described in detail. Unless otherwise specified again, the materials, the shapes and so on are similar to those in Embodiment 1 described above. Such portions are represented by the same reference numerals or symbols and will be omitted from detailed description.

Figure 10:
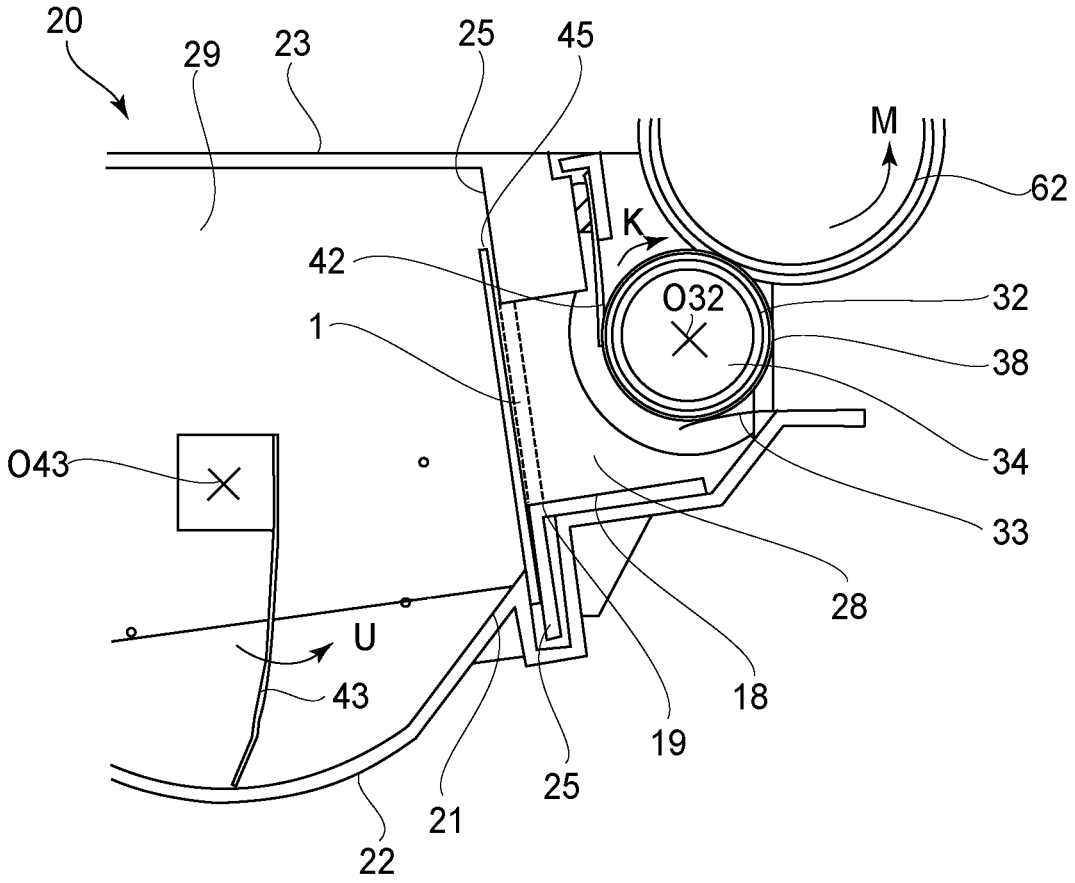
FIG. 10 is a schematic sectional view of a developing roller and its peripheral portion of a process cartridge according to Embodiment 3.

A structure of a peripheral portion of the developing roller 32 in this embodiment will be described using FIG. 10. FIG. 10 is a sectional view of the developing roller 32 and its peripheral portion in the developing unit 20 similarly as FIGS. 1 and 9.

In Embodiment 3, the part 19, of the first frame 23, defining the opening 1 and the part 18, of the first frame 23, forming the lower inner surface of the toner supplying chamber 28 are disposed in the same plane. In the toner chamber 29 side, in the neighborhood of the toner sealing member 45, a lower inner surface 21 of the toner chamber 29 is formed downward from the flange 25.

The plane in which the part 19, of the first frame 23, defining the opening 1 and the part 18, of the first frame 23, forming the lower inner surface of the toner supplying chamber 28 exist is disposed above the toner chamber lower inner surface 21 in the neighborhood of the sealing member 45. As a result, a region where there is a possibility of stagnation of the toner in the toner supplying chamber 28 is eliminated.

Also in this embodiment, similarly as in Embodiments 1 and 2, the toner, in the toner chamber 29, fed by the rotation of the feeding member 43 passes through the opening 1 and is supplied from the toner supplying chamber 28 to the developing roller 32, and therefore the toner does not stagnate at the lower portion of the toner supplying chamber 28.

(Embodiment 4)

Figure 11:
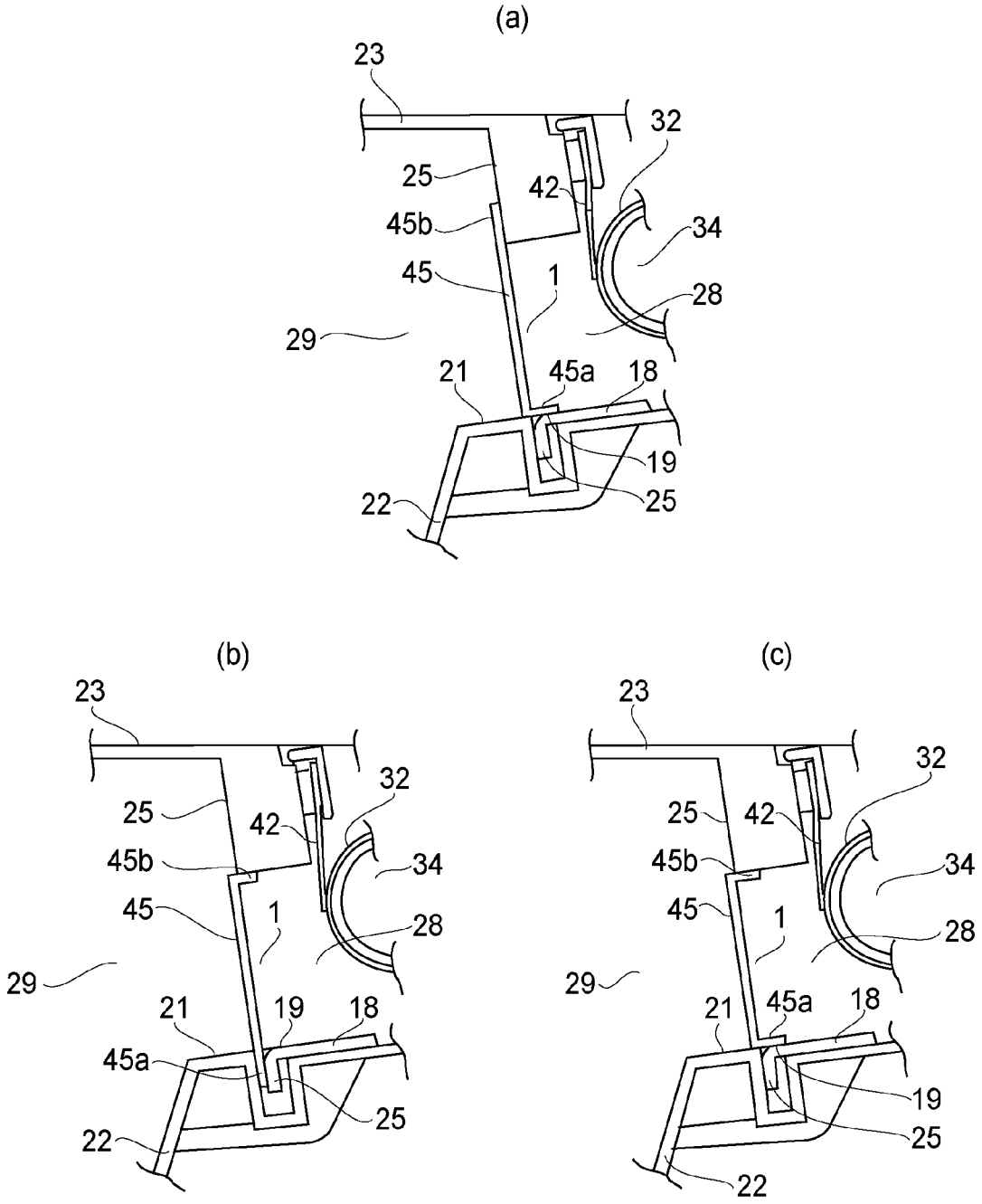
In FIG. 11, (a) to (c) are schematic sectional views each showing a mounted state of a sealing member in Embodiment 4.

In FIGS. 1 to 3, a mounted state of the sealing member 45 for sealing the opening 1 can also be changed to those as shown in (a) to (c) of FIG. 11.

In FIG. 11, (a) shows a state in which a lower edge portion 45*a* of the sealing member 45 is bent toward the toner supplying chamber 28 side and is welded with (bonded to) the part 19, of the toner supplying chamber 28, defining the opening 1. An upper edge portion 45*b* of the sealing member 45 is welded with a surface of the flange 25 in the toner chamber 29 side. In this state, the sealing member 45 is mounted and thus the opening 1 is sealed (closed).

In FIG. 11, (b) shows a state in which a lower edge portion 45*a* of the sealing member 45 is welded with a surface of the flange 25 in the toner chamber 29 side. An upper edge portion 45*b* of the sealing member 45 is bent toward the toner supplying chamber 28 side and is welded with a part, of the toner supplying chamber 28, defining the opening 1. In this state, the sealing member 45 is mounted and thus the opening 1 is sealed.

In FIG. 11, (c) shows a state in which each of both of a lower edge portion 45*a* and an upper edge portion 45*b* of the sealing member 45 is bent toward the toner supplying chamber 28 and is welded with the associated part, of the toner supplying chamber 28, defining the opening 1. In this state, the sealing member 45 is mounted and thus the opening 1 is sealed.

[Other Embodiments]

(1) In Embodiments 1 to 3, the developing device 20 is used as the developing unit, and is assembled with the cleaning unit 60 including the electrophotographic photosensitive drum 62 as the image bearing member into the process cartridge B of the so-called integral type. However, the developing device 20 can also be used alone in the form of the developing cartridge detachably mountable to the apparatus main assembly A. Further, the developing device 20 can also be used in the form in which the developing device 20 is disposed alone in the apparatus main assembly A.

(2) The type of the image bearing member 62 is not limited to the drum type as in Embodiments 1 to 3. The image bearing member 62 can be of a flexible endless belt type.

(3) The developing type of the developing device 20 is not limited to the developing type using the one-component magnetic developer as in Embodiments 1 to 3. The developing type may also be a developing type using a one-component non-magnetic developer or a developing type using a so-called two-component developer.

(4) The image forming principle and the image forming process of the image forming portion of the image forming apparatus are not limited to the electrophotographic process as in Embodiments 1 to 3. The process may also be an electrostatic recording process using a dielectric member as the image bearing member, a magnetic recording process using a magnetic member as the image bearing member, and the like process. The image forming apparatus is not of the transfer type, but may also be a direct type in which photosensitive paper (electrofacsimile paper) or electrostatic recording paper is used as the recording material (image bearing member) and the image is directly formed on the recording material.

According to the present invention, it is possible to provide a developing device in which a degree of stagnation of the developer at the lower portion of the developer supplying chamber and the circulation of the developer in the developer supplying chamber is improved. It is also possible to provide a process cartridge including the developing device. It is further possible to provide an image forming apparatus using the developing device or the process cartridge.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-179995 filed on Sep. 4, 2014, which is hereby incorporated by reference herein in its entirety.

What is claimed is:

1. A developing device comprising:

a developer chamber in which developer is accommodated;

a developer supplying chamber in which a developer carrying member for developing a latent image forming on an image bearing member is rotatably provided and which is provided with an opening communicating with said developer chamber;

a sealing member for sealing the opening; and a feeding member for feeding the developer from said developer chamber to said developer supplying chamber through the opening, wherein said feeding member is rotatably provided in said developer chamber and has a rotation center below a rotation center of the developer carrying member, wherein a first surface of said developer supplying chamber defining a lower inner surface of the opening connects with a second surface defining a lower inner surface of said developer supplying chamber, wherein said first surface of said developer supplying chamber and said second surface of said developer supplying chamber are provided in a same plane in a direction of developer flow, and the same plane is flush with or provided above a lower inner surface of said developer chamber.

2. A developing device comprising:

a first frame, provided with an opening;

a second frame;

a developer chamber and a developer supplying chamber formed by connection between said first frame and said second frame to communicate with each other through the opening;

a sealing member for sealing the opening;

a developer carrying member, rotatably provided in said developer supplying chamber, for carrying developer; and a feeding member for feeding the developer from said developer chamber to said developer supplying chamber through the opening, wherein said feeding member is rotatably provided in said developer chamber and has a rotation center below a rotation center of the developer carrying member, wherein a surface of said first frame defining the opening and a surface of said first frame forming a lower inner surface of said developer supplying chamber are provided in a same plane, and the same plane is flush with or provided above a lower inner surface of said developer chamber.

3. A developing device according to claim 1, wherein the developer is a one-component developer, wherein said developer carrying member includes a magnet non-rotatably fixed inside said developer carrying member, and wherein the lower inner surface of said developer supplying chamber below said developer carrying member is provided with a range of a distance in which the developer is held on said developer carrying member by a magnetic force of the magnet.

4. A developing device according to claim 1, further comprising a flange, wherein the opening is provided in said flange, and a lower portion of said flange extends downward.

5. A developing device according to claim 4, wherein said sealing member for sealing the opening is mounted in a side toward said developer chamber.

6. A developing device according to claim 1, wherein said developing device is a developing cartridge detachably mountable to a main assembly of an image forming apparatus for forming an image on a recording material.

7. A process cartridge detachably mountable to a main assembly of an image forming apparatus for forming an image on a recording material, said process cartridge comprising at least:

a rotatable image bearing member on which a latent image is to be formed; and a developing device according to claim 1.

8. A process cartridge according to claim 7, wherein said image bearing member is an electrophotographic photosensitive member of a drum type or an endless belt type.

9. An image forming apparatus for forming an image on a recording material, comprising:

a rotatable image bearing member on which a latent image is to be formed; and a developing device according to claim 1.

10. An image forming apparatus according to claim 9, wherein said developing device is a developing cartridge detachably mountable to a main assembly of said image forming apparatus.

11. An image forming apparatus according to claim 9, wherein at least said image bearing member and said developing device constitute a process cartridge detachably mountable to a main assembly of said image forming apparatus.

12. An image forming apparatus according to claim 9, wherein said image bearing member is an electrophotographic photosensitive member of a drum type or an endless belt type.

13. A developer device according to claim 1, further comprising:

a flange provided with the opening, wherein the same plane is disposed in a direction crossing said flange.

14. A developing device according to claim 1, further comprising:

a first frame provided with the opening; and a second frame connected with said first frame;

wherein said developer chamber and said developer supplying chamber are formed by connection between said first frame and said second frame to communicate with each other through the opening.

15. A developing device according to claim 2, wherein said first frame constitutes an upper portion of a casing, and said second frame constitutes a bottom portion of said casing.

* * * * *